US008824929B2

(12) United States Patent
Campbell et al.

(10) Patent No.: US 8,824,929 B2
(45) Date of Patent: Sep. 2, 2014

(54) METHOD FOR INCREASING USEFUL LIFE OF AN IMAGE FORMING APPARATUS

(75) Inventors: Alan Stirling Campbell, Lexington, KY (US); David Brian Langer, Lexington, KY (US); Peter Brown Pickett, Lexington, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 478 days.

(21) Appl. No.: 12/838,564

(22) Filed: Jul. 19, 2010

(65) Prior Publication Data

US 2011/0293327 A1 Dec. 1, 2011

Related U.S. Application Data

(60) Provisional application No. 61/349,802, filed on May 28, 2010.

(51) Int. Cl.
*G03G 15/00* (2006.01)

(52) U.S. Cl.
USPC ..... 399/167

(58) Field of Classification Search
USPC ..... 399/66, 159, 167, 299, 302, 44; 347/115, 117
See application file for complete search history.

(56) References Cited

U.S. PATENT DOCUMENTS

| | | | | |
|---|---|---|---|---|
| 6,643,484 | B2 | 11/2003 | Kojima et al. | |
| 7,016,627 | B2 * | 3/2006 | Shibuya et al. | 399/167 |
| 7,395,012 | B2 * | 7/2008 | Kojima | 399/167 |
| 7,603,073 | B2 * | 10/2009 | Kojima | 399/396 |
| 7,684,717 | B2 * | 3/2010 | Izumi et al. | 399/44 |
| 7,729,649 | B2 | 6/2010 | Horrall et al. | |
| 8,095,044 | B2 * | 1/2012 | Maeda et al. | 399/167 |

FOREIGN PATENT DOCUMENTS

| | | | |
|---|---|---|---|
| JP | 08-262940 | A * | 10/1996 |
| JP | 2001154559 | A * | 6/2001 |
| JP | 2001215769 | A * | 8/2001 |
| JP | 2003241536 | A * | 8/2003 |
| JP | 2006235454 | A * | 9/2006 |

* cited by examiner

*Primary Examiner* — Robert Beatty
(74) *Attorney, Agent, or Firm* — William F. Esser

(57) ABSTRACT

An image forming apparatus includes a plurality of photoconductive drums, each photoconductive drum transferring a portion of a toner image to an intermediate transfer member. The photoconductive drums are individually rotated to a printing speed such that a downstream photoconductive drum starts rotating prior to an adjacent upstream photoconductive drum starts image transfer. Similarly, an upstream photoconductive drum starts deceleration when its following downstream station has transferred image.

33 Claims, 7 Drawing Sheets

METHOD FOR INCREASING USEFUL LIFE OF AN IMAGE FORMING APPARATUS

CROSS REFERENCE TO RELATED APPLICATION

Pursuant to 37 C.F.R. §1.78, this claims the benefit of the earlier filing date of application Ser. No. 61/349,802 filed May 28, 2010, entitled, "A Method for Increasing Useful Life of an Image Forming Apparatus."

BACKGROUND

1. Field of the Invention

The present invention relates generally to an image forming apparatus and, more particularly, to a system and method for reducing the churning of toner in the image forming apparatus.

2. Description of the Related Art

An image forming apparatus, such as a color printer typically includes four image forming stations associated with four colors, black, magenta, cyan, and yellow. Each image forming station includes a laser to expose a latent image on the charged surface of a photoconductive drum. The latent image on each photoconductive drum is developed with the appropriate color toner and is then transferred to either an intermediate transfer medium or directly to a media (such as paper) that travels past the photoconductive drums. The unfused toner on the media is then fused to the media by application of heat and pressure in a fuser assembly.

In the process of printing a sequence of pages, the image forming station runs for a short time before printing the first page (run in) and runs for a short period of time after printing the last page (run out). The run in and run out processes are required to prepare the various components of the image forming station before printing and to clean the image forming station after completion of printing, respectively. When a print job includes a small number of pages, the overhead time consumed during run in and run out is more than the time required for actual printing of the pages. Excessive amount of time spent during run in and run out results in a degradation of print quality due to recycling of toner in the image forming stations of the image forming apparatus. Toner that is not used in the printing process is re-circulated many times before it is used for printing. This repeated recycling of the toner is known as churn and results in print quality defects such as starvation, grainy print, and poor transfer to the media.

In the image forming apparatus, the photoconductive drums that print each color are arranged in tandem and typically all the photoconductive drums start rotating at the same time. This is done to provide a stable motion quality of the photoconductive drums within the image forming apparatus, however since the upstream image forming stations are used before the downstream stations, the downstream stations experience toner churn that is not productive at the beginning of a print job. Similarly during the completion of the print job, the upstream stations experience toner churn until the downstream station complete the image transfer process.

Further, the photoconductive drum transfers its image to an intermediate transfer member that accumulates the images from each of the four imaging forming stations. The intermediate transfer member then transfers the accumulated image to a media at a second transfer point. In the prior art system, the photoconductive drums continue to rotate until the intermediate transfer member completes transfer of the image to the media at the second transfer point. This linkage between the running of the photoconductive drums and the intermediate transfer member is done to improve motion quality and reduce slippage that might cause damage to the photoconductive drums or the intermediate transfer member. However, this process also results in toner churn that is undesirable.

Therefore, it is desirable to increase the useful life of the image forming apparatus by reducing excess toner churn.

SUMMARY OF THE INVENTION

Embodiments of the present invention overcome the shortcomings of prior imaging systems and thereby satisfy a significant need for an improved image forming system, generally by sequencing the running of each image forming station such that the station does not start running until at or near the latest possible opportunity to do so, and stops running at or near the earliest opportunity to stop at the end of a print job.

Disclosed herein is an image forming apparatus including an intermediate transfer member; a plurality of photoconductive drums in contact with the intermediate transfer member, the plurality of photoconductive drums transferring an image to the intermediate transfer member during a print operation; a plurality of charging rollers positioned in contact with the plurality of photoconductive drums; and a controller providing instructions to the image forming stations that sequentially starts and then ramps the speed of the photoconductive drums so that the controller can control the start of imaging on an upstream image forming station while preparing the components of a downstream image forming station, and then after completing the imaging process at an image forming station, the controller then sequentially starts decelerating each photoconductive drum from the print speed towards a stationary position after completing the printing operation.

In some embodiments, a photoconductive drum begins rotating after an immediately upstream photoconductive drum begins accelerating but prior to the laser exposing the upstream photoconductive drum. Further, a photoconductive drum begins deceleration after image transfer is completed by an immediately downstream photoconductive drum. By controlling run-in and run-out for the photoconductive drums individually, the revolutions of each photoconductive drum may be limited to substantially only include the time necessary to perform run-in and run-out functions for the drum. Reduction in photoconductive drum revolutions substantially reduces toner churn which thereby extends cartridge life.

Additional features and advantages of the invention will be set forth in the detailed description which follows and in part will be readily apparent to those skilled in the art from that description or recognized by practicing the invention as described herein, including the detailed description, which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
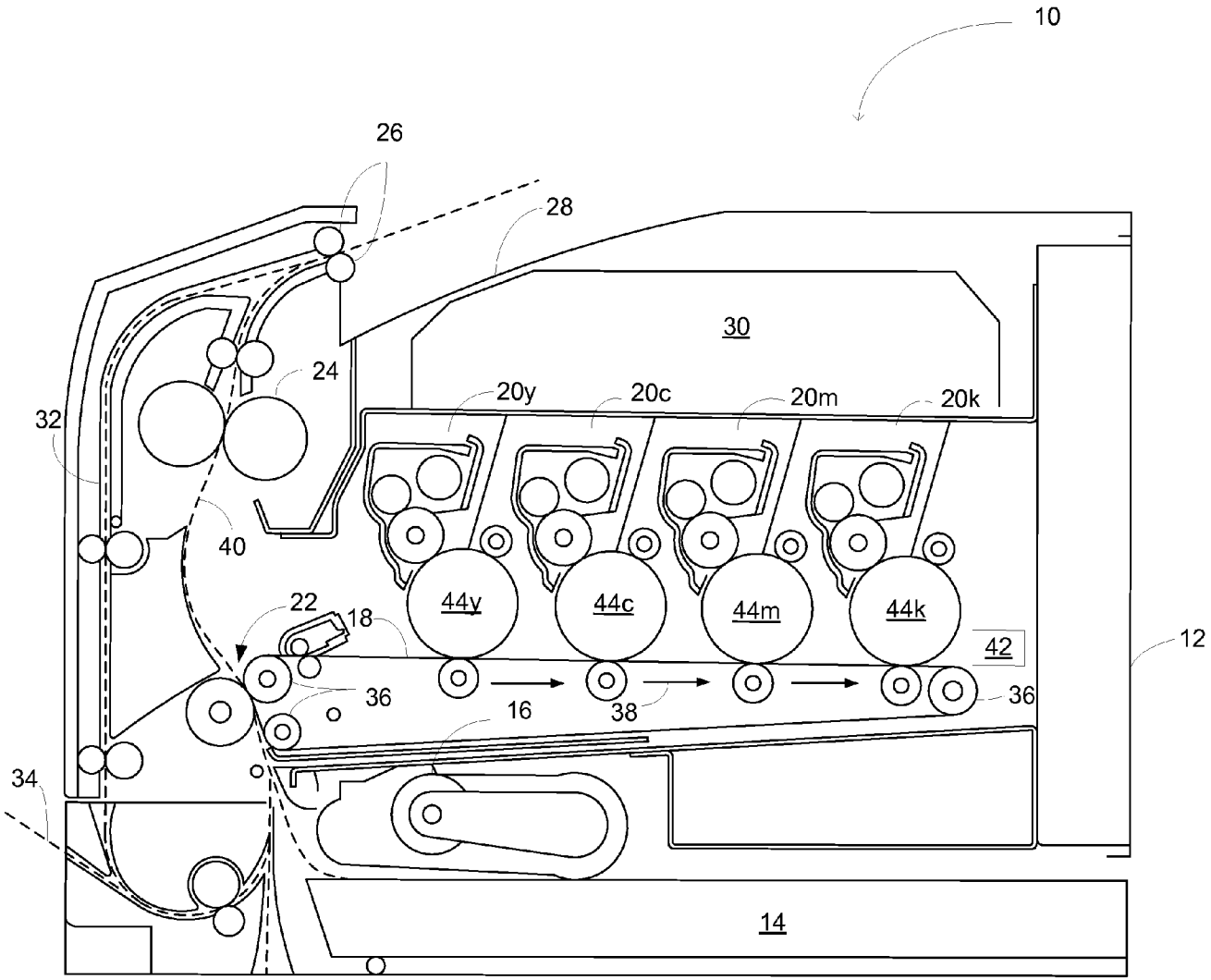
FIG. 1 is a side view of one embodiment of an image forming apparatus according to the present invention.

It is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof are used broadly and encompass direct and indirect connections, couplings and mountings. In addition, the terms "connected" and "coupled" and variations thereof are not restricted to physical or mechanical connections or couplings.

Reference will now be made in detail to the exemplary embodiment(s) of the invention, as illustrated in the accompanying drawings. Whenever possible, the same reference numerals will be used throughout the drawings to refer to the same or like parts.

FIG. 1 illustrates an image forming apparatus 10 according to the present invention. The image forming apparatus 10 includes a main body 12, a media tray 14, a pick mechanism 16, an intermediate transfer member 18, a plurality of image forming units 20*y*, 20*c*, 20*m*, and 20*k*, a second transfer area 22, a fuser assembly 24, exit rollers 26, an output tray 28, a print head 30, and a duplex path 32. An auxiliary feed 34 allows a user to manually feed print media into the image forming apparatus 10.

The intermediate transfer member 18 is formed as an endless transfer belt supported about a plurality of support rollers 36. During image forming operations, transfer member 18 moves in the direction of arrow 38 past the plurality of image forming stations 20*y*, 20*c*, 20*m*, and 20*k* for printing with yellow, cyan, magenta, and black toner, respectively. Each image forming stations 20*y*, 20*c*, 20*m*, and 20*k* applies a portion of an image on the transfer member 18. The moving transfer member 18 conveys the image to a print media at the second transfer area 22.

The media tray 14 is positioned in a lower portion of the main body 12 and contains a stack of media. The media tray 14 is removable for refilling. Pick mechanism 16 picks print media from top of the media stack in the media tray 14 and feeds the print media into a primary media path 40. The print media is moved along the primary media path 40 and receives the toner image from the transfer member 18 at the second transfer area 22.

Once the toner image is transferred, the print media is conveyed along the primary media path 40 to the fuser assembly 24. The fuser assembly 24 fuses the toner to the print media and conveys the print media towards the exit rollers 26. Exit rollers 26 either eject the print media to the output tray 28, or direct it into the duplex path 32 for printing on a second side of the print media. In the latter case, the exit rollers 26 partially eject the print media and then reverse direction to invert the print media and direct it into the duplex path 32. A series of rollers in the duplex path 32 return the inverted print media to the primary media path 40 upstream from the second transfer area 22 for printing on the second side of the media.

The image forming apparatus 10 also includes a controller 42 that provides instructions to the image forming apparatus 10 for performing imaging.

Figure 2:
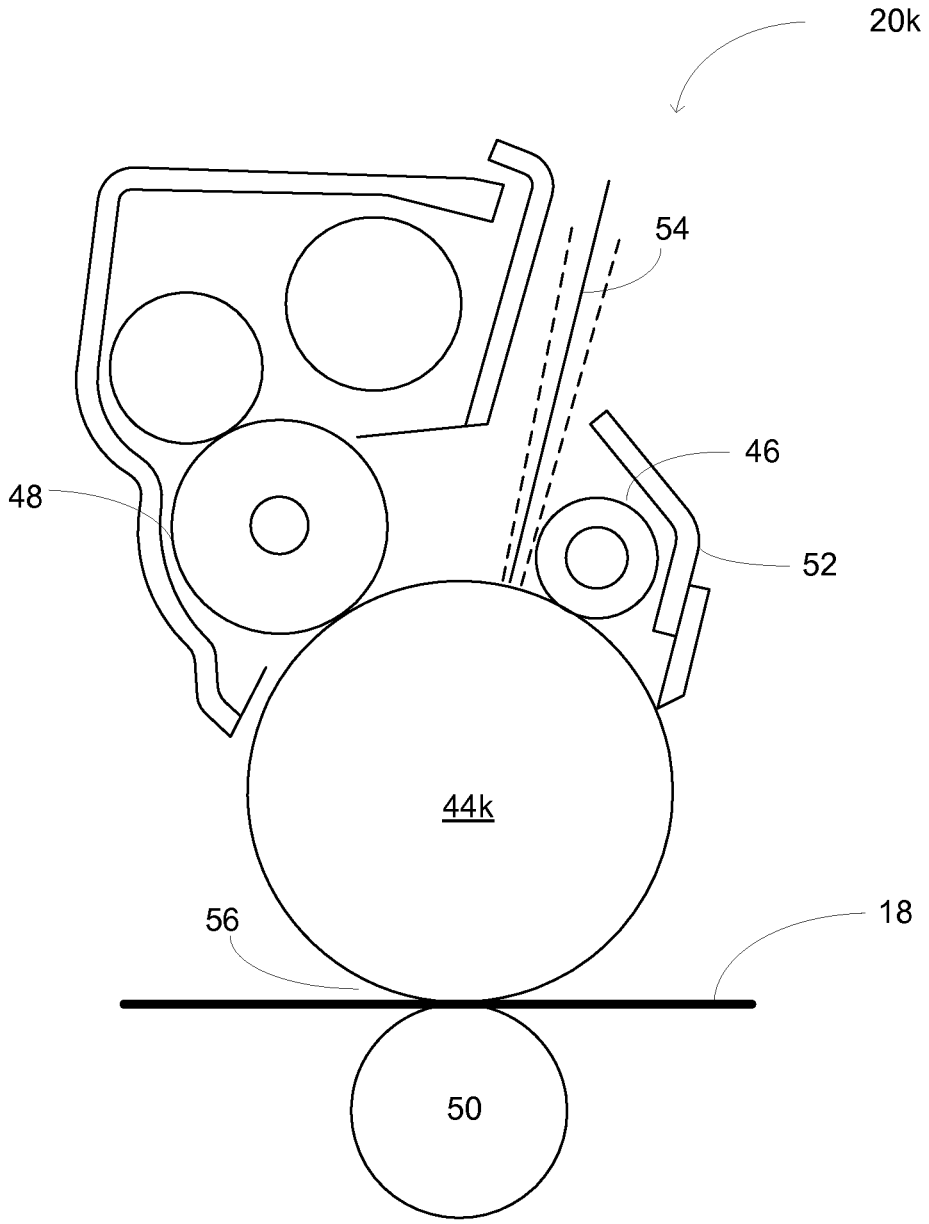
FIG. 2 is a side view of one embodiment of an image forming station of the image forming apparatus of FIG. 1.

FIG. 2 is a side view of one of the image forming stations 20*y*, 20*c*, 20*m*, and 20*k* of the image forming apparatus 10 of FIG. 1. The image forming station depicted in FIG. 2 may represent any of the image forming stations 20*y*, 20*c*, 20*m*, or 20*k* having yellow, cyan, magenta, or black toner. For sake of simplicity, the image forming station shown in FIG. 2 is the image forming station 20*k* having black toner.

The image forming station 20*k* in FIG. 2 includes a rotating photoconductive drum 44*k*, a charging roller 46, a developer roller 48, a transfer roller 50, and a cleaning member 52. The charging roller 46 is in contact with the photoconductive drum 44*k* and charges the surface of the photoconductive drum 44*k*. A laser beam 54 from the printhead 30 exposes the surface of the photoconductive drum 44*k* and discharges areas of the surface of the photoconductive drum 44*k* it contacts to form a latent image.

The developer roller 48 transports negatively charged toner to the surface of the photoconductive drum 44*k* to develop a latent image on the photoconductive drum 44*k* in the areas exposed by the laser beam 54. The developer roller 48 is held more negative than the discharged areas of the photoconductive drum 44*k*. The toner is attracted to the most positive surface, i.e., the area discharged by the laser beam 54 and is repelled by more negatively charged areas of the photoconductive drum 44*k* (i.e., those not discharged). As the photoconductive drum 44*k* rotates, a positive voltage field produced by the transfer roller 50 attracts and transfers the toner adhering to the discharged areas on the surface of the photoconductive drum 44*k* to the intermediate transfer member 18. Any remaining toner on the photoconductive drum 44*k* is then removed by the cleaning member 52.

Figure 3:
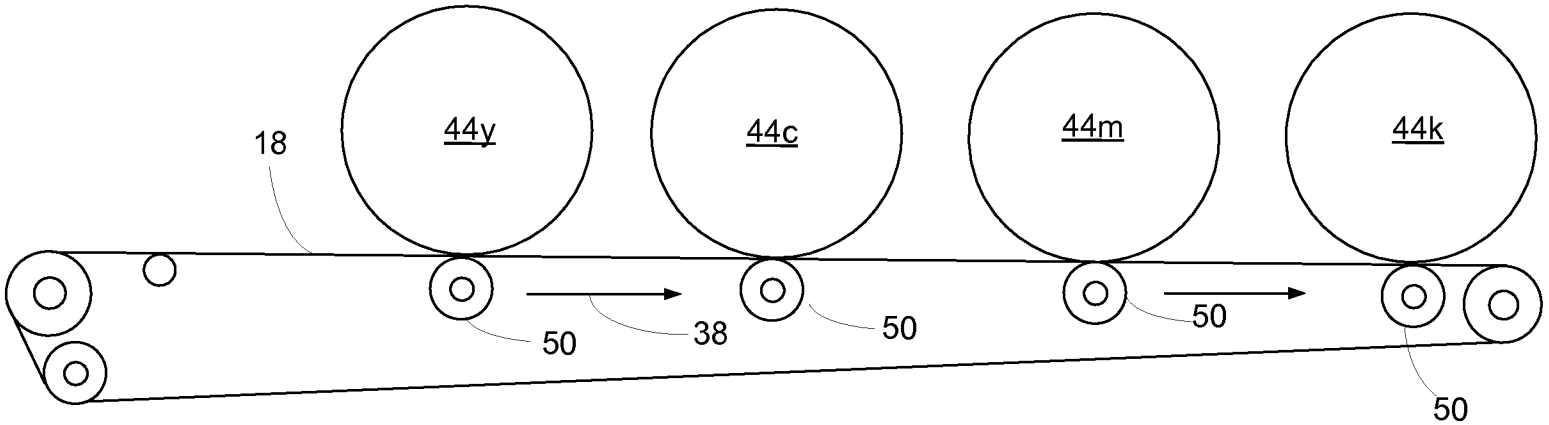
FIG. 3 is a side view of the photoconductive drums, the transfer member, and the transfer rollers of the image forming apparatus of FIG. 1.

FIG. 3 is a side view of a plurality of photoconductive drums 44*y*, 44*c*, 44*m*, and 44*k*, the intermediate transfer member 18, and the transfer rollers 50 of the image forming apparatus 10 of FIG. 1. The plurality of photoconductive drums 44*y*, 44*c*, 44*m*, and 44*k* include a first photoconductive drum 44*y* for transferring yellow toner, a second photoconductive drum 44*c* for transferring cyan toner, a third photoconductive drum 44*m* for transferring magenta toner, and a fourth photoconductive drum 44*k* for transferring black toner. The first photoconductive drum 44*y*, the second photoconductive drum 44*c*, the third photoconductive drum 44*m*, and the fourth photoconductive drum 44*k* are arranged in tandem in the direction of rotation shown by arrow 38 of the intermediate transfer member 18. The plurality of transfer rollers 50 are disposed opposite the plurality of photoconductive drums 44*y*, 44*c*, 44*m*, and 44*k* on the opposite side of the transfer member 18. Each photoconductive drum 44*y*, 44*c*, 44*m*, and 44*k* transfers a portion of the image to the intermediate transfer member 18 sequentially, i.e., the first photoconductive drum 44*y* transfers a portion of the image, followed by the second photoconductive drum 44*c*, the third photoconductive drum 44*m*, and finally the fourth photoconductive drum 44*k*. The four photoconductive drums 44*y*, 44*c*, 44*m*, and 44*k* are in an initial stationary position before starting the imaging process.

The following example illustrates the number of photoconductive drum revolutions performed by prior art systems, with the following assumptions:

the distance between the stations is 100 mm;

photoconductive drum circumference is 94 mm;

the distance from laser imaging to transfer is 45 mm; and the distance from image forming station (IFS) 20*k* to second transfer is 400 mm.

All four image forming stations 20 are started simultaneously and are prepared to start imaging when IFS 20*y* begins imaging. The run-in preconditioning requires about two revolutions of photoconductive drums 44. Once imaging starts on IFS 20*y*, IFS 20*k* will turn an additional 3.2 revolutions (100 mm station spacing * 3 image forming stations 20)/94 mm drum circumference) by the time the image on the transfer medium 18 arrives for transfer at IFS 20*k*. All four image forming stations 20 will see the additional 3.2 revolutions either at run-in, at run-out or a combination of the two. In addition, there are an additional 4.25 revolutions (400 mm distance to second transfer point/94 mm drum circumference) from transfer at IFS 20*k* to second transfer. The photoconductive drum revolutions to print a letter size page is 3.5 (279.4 mm length for letter sheet/94 mm drum circumference). Now, assuming 2 additional drum revolutions to account for run-out, then the total drum revolutions for a single letter sized media sheet is about 14.95 for an efficiency of about 23% (corresponding to 3.5 revolutions for the letter sized sheet/14.95 total drum revolutions). In contrast, in the proposed exemplary embodiment of the present invention, the photoconductive drum revolutions associated with the station spacing and the distance from IFS 20*k* to second transfer are substantially reduced or substantially eliminated so that the total photoconductive drum revolutions is reduced to 7.5 with an efficiency of 47% (corresponding to 3.5 revolutions for a letter sized sheet /17.5 total drum revolutions).

Rules for Photoconductive Drum Acceleration

Figure 4:
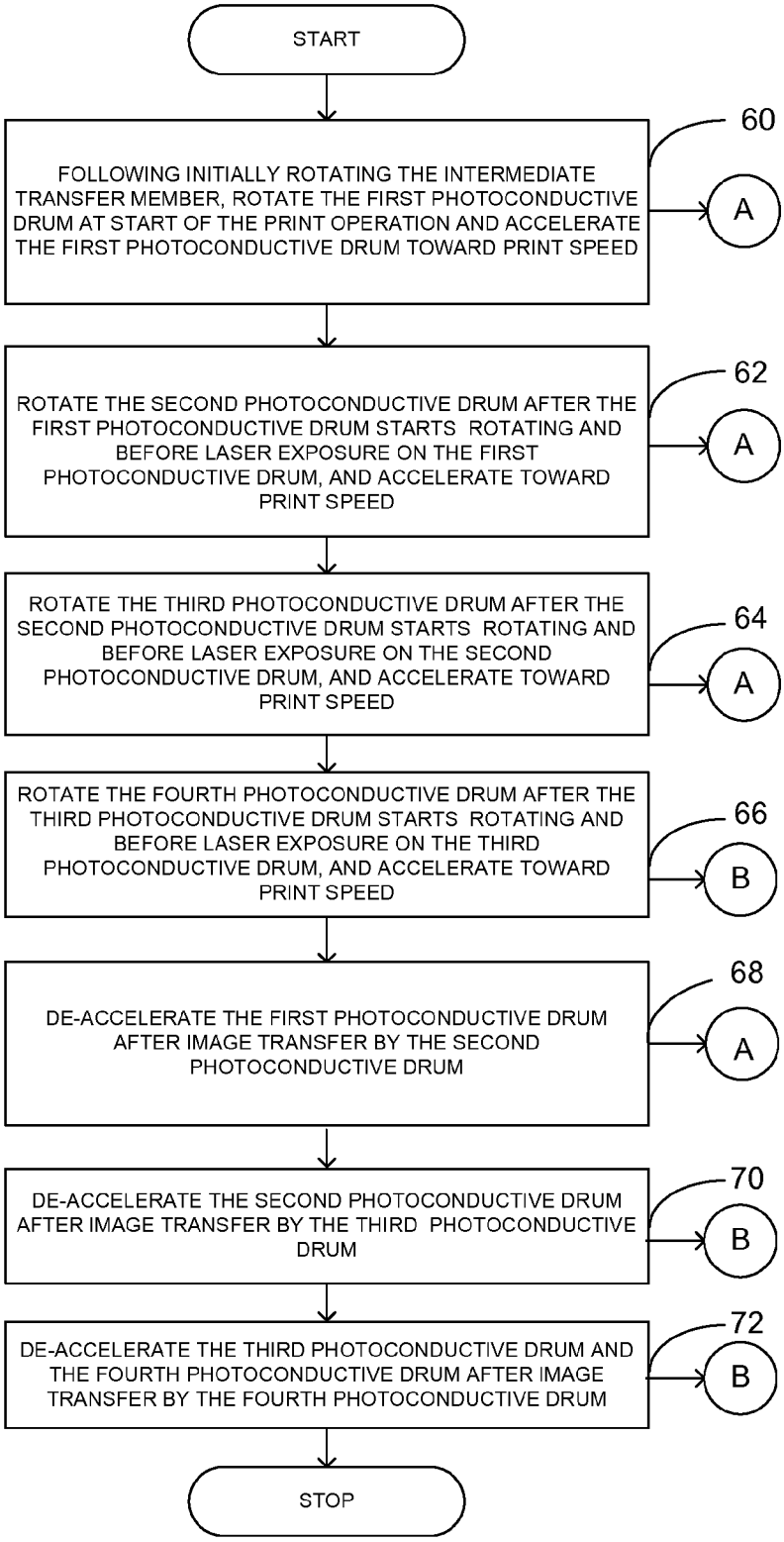
FIG. 4 is a flow diagram illustrating the operations performed on or by the photoconductive drums of FIG. 3.

FIG. 4 is a flow diagram illustrating the operation of the photoconductive drums 44*y*, 44*c*, 44*m*, and 44*k* of FIG. 3 during the image transfer process. In general terms, photoconductive drums 44 are individually and/or separately accelerated and decelerated using controlled ramps during the print operation in order to reduce photoconductive drum revolutions and thus toner churn. In this case, a set of rules are used to determine when to start each of the ramps.

In order to align each of the four color planes in the process direction, imaging of each downstream plane by an image forming station 20 takes place a fixed time after imaging takes place by its immediately upstream image forming station 20. This fixed time between imaging by each downstream image forming station 20 is substantially equal to the distance between image forming stations 20 divided by the process speed. Churn is substantially markedly reduced when the time between the end of the acceleration ramp, i.e., when a photoconductive drum 20 first substantially reaches process speed, and the start of the imaging is substantially or nearly minimized. It follows that the end of each acceleration ramp is separated by a time substantially equal to the distance between image forming stations 20 divided by the process speed.

Second, in order to substantially reduce churn the acceleration ramp distance should be substantially as short as practical. For a system that can achieve complete photoconductive drum charging in a single pass, this ramp distance would be the distance from charge to image. For embodiments of the present invention, it is assumed that two charge cycles are needed so the acceleration ramp distance is one photoconductive drum circumference plus the distance from charge to image.

Third, the acceleration of a downstream image forming station 20 occurs such that it does not cause appreciable motion disturbance on an upstream image forming station 20 of an amount that is large enough to produce a print artifact while the upstream station is imaging. Fourth, if the acceleration of a downstream image forming station 20 is capable of producing a motion quality artifact in an upstream image forming station, then the downstream image forming station 20 is started before the upstream image forming station 20 starts to image. This requires that the time for the acceleration ramp be longer than the travel time between image forming stations 20.

With reference to FIG. 4, at block 60 the controller 42 provides instructions to the image forming station 20*y* to rotate the first photoconductive drum 44*y* at start of the print operation. The controller 42 provides instructions to accelerate the first photoconductive drum 44*y* at a controlled ramp to reach the desired print speed. The photoconductive drum 44*y* surface is charged to the desired print level by charge roll 46.

Next, at block 62 the controller 42 provides instructions to the image forming station 20*c* to start rotating the second photoconductive drum 44*c*. In order to substantially reduce the churn and prevent the occurrence of a print artifact due to the immediately downstream photoconductive drum 44*c* starting while imaging at the immediate upstream photoconductive drum 44*y*, the downstream photoconductive drum 44*c* starts prior to the laser beam 54 generated by image forming station 20*y* exposing the surface of the upstream photoconductive drum 44*y*. The controller 42 starts the second photoconductive drum 44*c* rotating based on the distance between the image forming stations 40, the circumference of the photoconductive drums 44 and the acceleration ramp. The acceleration ramp is set to be such that the leading edge of the image of downstream photoconductive drum 44*c* on transfer member 18 coincides with the leading edge of the image of upstream photoconductive drum 44*y* on the transfer member 18 at the transfer point 50 corresponding to downstream photoconductive drum 44*c* while at the same time substantially reducing the number of revolutions on the downstream photoconductive drum 44*c*.

At block 64, the controller 42 provides instructions to the image forming apparatus 10 to start rotating the third photoconductive drum 44*m* after the second photoconductive drum 44*c* begins accelerating but prior to the corresponding laser exposing the second photoconductive drum 44*c* to create its latent image. The controller 42 provides instructions to accelerate the third photoconductive drum 44*m* toward the print speed.

At block 66, the controller 42 provides instructions to the image forming apparatus 10 to start rotating the fourth photoconductive drum 44*k* after the third photoconductive drum 44*m* begins accelerating but prior to the corresponding laser exposing the third photoconductive drum 44*m* to create its latent image. The controller 42 provides instructions to accelerate the fourth photoconductive drum 44*k* toward a print speed at which the corresponding laser can begin exposing the fourth photoconductor drum 44*k* to create its latent image.

Rules for Photoconductive Drum Deceleration

At block 68, the controller 42 provides instructions to the image forming apparatus 10 to start decelerating the first photoconductive drum 44*y* from the print speed. The deceleration of the first photoconductive drum 44*y* is started when the second photoconductive drum 44*c* has completed its image transfer, i.e., after a trailing edge of the image passes the transfer nip formed between the second photoconductive drum 44*c* and its corresponding transfer roller 50. At block 70, the controller 42 provides instructions to the image forming apparatus 10 to start decelerating the second photoconductive drum 44*c* rotating at print speed. The deceleration of the second photoconductive drum 44*c* is started when the third photoconductive drum 44*m* has completed its image transfer, i.e., after a trailing edge of the image passes the transfer nip formed between the third photoconductive drum 44*m* and its corresponding transfer roller 50.

Finally, at block 72, the controller provides instructions to the image forming apparatus 10 to start decelerating the third photoconductive drum 44*m* and subsequently the fourth photoconductive drum 44*k* rotating at print speed. The deceleration of third photoconductive drum 44*m* and the fourth photoconductive drum 44*k* is started after the fourth photoconductive drum 44*k* has completed image transfer, i.e., after a trailing edge of the image passes the transfer nip formed between the fourth photoconductive drum 44*k* and its corresponding transfer roller 50.

As noted above, according to exemplary embodiments of the present invention each photoconductive drum 44*y*, 44*c*, 44*m*, and 44*k* begins and ends rotation sequentially, one after the other, and not simultaneously as in prior systems. Separately rotating the photoconductive drums 44*y*, 44*c*, 44*m*, and 44*k* in a sequential manner as described above results in each photoconductive drum 44*y*, 44*c*, 44*m*, and 44*k* undergoing a reduced number of revolutions prior to image transfer. According to exemplary embodiments of the present invention, the reduced rotations performed by each of the photoconductive drum 44*y*, 44*c*, 44*m*, and 44*k* before image transfer may correspond to approximately a minimum distance needed to perform a run-in task, such as to charge the photoconductive drum, or to otherwise be ready to perform an image transfer.

Similarly, the deceleration process is such that each photoconductive drum 44*y*, 44*c*, 44*m*, and 44*k* performs a reduced number of revolutions. The reduced revolutions by the photoconductive drums 44*y*, 44*c*, 44*m*, and 44*k* to decelerate from the print speed to a stationary position may correspond to or approach approximately a minimum distance needed to perform a run-out task or to otherwise be ready for a subsequent image transfer operation.

For instance, the reduced revolutions of a photoconductive drum 44 during deceleration may include or be otherwise based on a distance needed to perform a cleaning cycle for the corresponding charging roll 46, the distance needed to provide a substantially uniformly charged surface of the photoconductive drum 44, and/or the distance between adjacent image forming stations 20. The approximately minimum distance for cleaning a charging roll 46 may be, for example, one revolution of the corresponding photoconductive drum 44. The approximately minimum distance for obtaining a substantially uniformly charged surface of a photoconductive drum 44 may be viewed as the circumference thereof. The reduced revolutions of a photoconductive drum 44 during deceleration may be the largest of the above three distances. Alternatively, if charge roll cleaning affects the charge appearing on the surface of the photoconductive drum 44, then the deceleration distance may be set to a combination of the distance to perform charge roll cleaning and the distance to substantially uniformly charge the photoconductive drum 44.

Rotating the photoconductive drums 44*y*, 44*c*, 44*m*, and 44*k* for a reduced number of revolutions reduces the time during which the toner is stirred, thereby reducing toner churn. Further, the additional rotations of the photoconductive drums 44*y*, 44*c*, 44*m*, and 44*k* in prior systems resulted in friction between the photoconductive drums 44*y*, 44*c*, 44*m*, and 44*k* and the cleaning member 52 that prematurely thins a coating on the surface of the photoconductive drum 44*y*, 44*c*, 44*m*, and 44*k*. As the coating thins, the photoconductive drums 44*y*, 44*c*, 44*m*, and 44*k* lose the ability to charge properly. Reducing the number of rotations of the photoconductive drums 44*y*, 44*c*, 44*m*, and 44*k* also addresses this wearing of the image forming apparatus 10.

Figure 5:
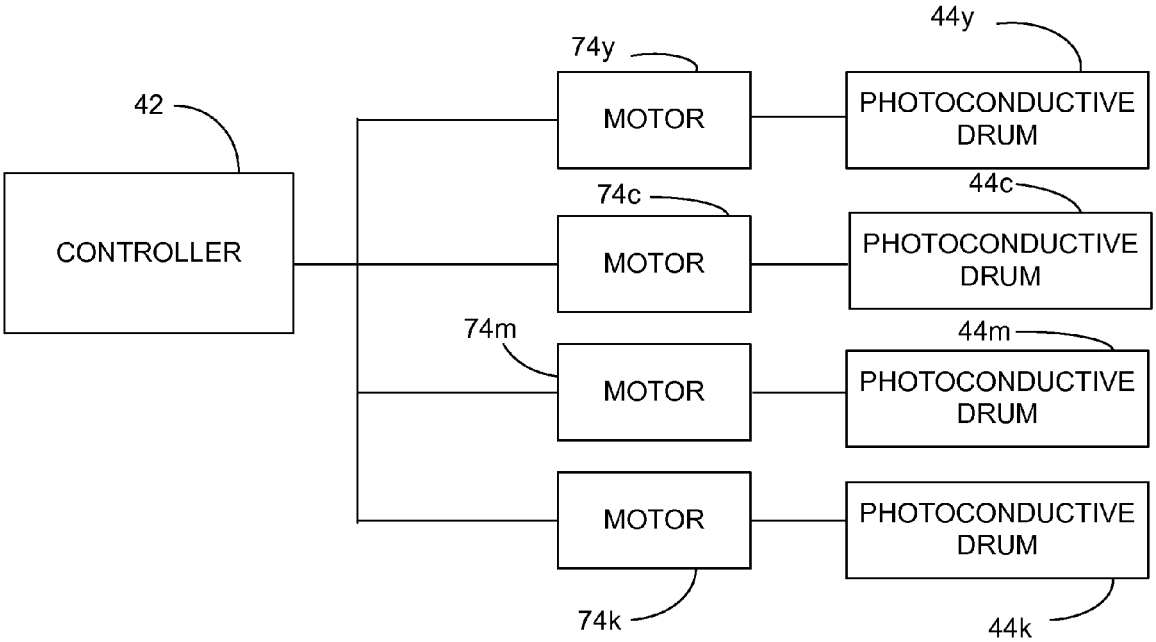
FIG. 5 is a block diagram illustrating the control of the photoconductive drums of FIG. 3 according to one embodiment of the present invention.

Various techniques may be used to control the rotation of the photoconductive drums 44*y*, 44*c*, 44*m*, and 44*k*. FIG. 5 is a block diagram illustrating the control of the photoconductive drums 44*y*, 44*c*, 44*m*, and 44*k* of FIG. 3 according to one embodiment of the present invention. The controller 42 is connected to a plurality of motors 74*y*, 74*c*, 74*m*, and 74*k*. An output of each motor 74*y*, 74*c*, 74*m*, and 74*k* is connected to the photoconductive drums 44*y*, 44*c*, 44*m*, and 44*k*, respectively. The controller 42 provides instructions to the motors 74*y*, 74*c*, 74*m*, and 74*k* for rotating and accelerating each photoconductive drum 44*c*, 44*m*, and 44*k* according to the flow diagram of FIG. 4.

The controller 42 also provides instructions to the image forming apparatus 10 to start rotating the intermediate transfer member 18 before rotating the first photoconductive drum 44*y*. The slip load of the stationary photoconductive drums 44*y*, 44*c*, 44*m*, and 44*k* helps the intermediate transfer member 18 to quickly reach a stable operating speed.

Further, the controller 42 provides instructions to the image forming apparatus 10 to perform various operations during the acceleration and the deceleration of each photoconductive drum 44*y*, 44*c*, 44*m*, and 44*k*.

Figure 6A:
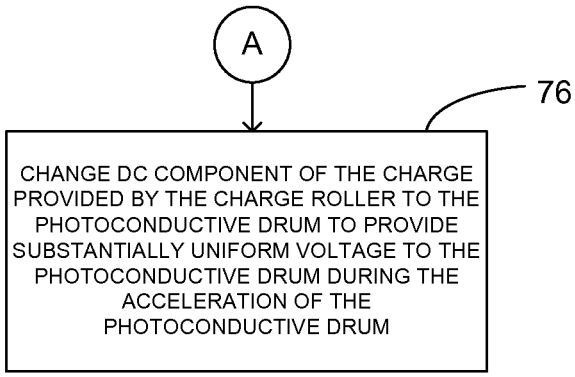
FIG. 6A is a block diagram illustrating the operation performed within the image forming apparatus during the acceleration of the photoconductive drums of FIG. 3 according to an exemplary embodiment of the present invention.

FIG. 6A is a block diagram illustrating the process performed during the acceleration of each photoconductive drum 44*y*, 44*c*, 44*m*, and 44*k* of FIG. 1. The charge that the charging roller 46 imparts on the surface of each corresponding photoconductive drum 44*y*, 44*c*, 44*m*, and 44*k* is a function of speed of rotation of the photoconductive drum 44*y*, 44*c*, 44*m*, and 44*k*. As shown in block 76 during the acceleration of each photoconductive drum 44*y*, 44*c*, 44*m*, and 44*k* the DC component of the charge provided by the charging roller 46 to each photoconductive drum 44*y*, 44*c*, 44*m*, and 44*k* is changed. Changing the DC component of the charge during acceleration helps provide a substantially uniform voltage to the photoconductive drums 44*y*, 44*c*, 44*m*, and 44*k* as the photoconductive drums 44*y*, 44*c*, 44*m*, and 44*k* accelerate. This ensures that the photoconductive drums 44*y*, 44*c*, 44*m*, and 44*k* are substantially uniformly charged during a reduced run-in time period in preparation for image formation on the photoconductive drum.

Figure 6B:
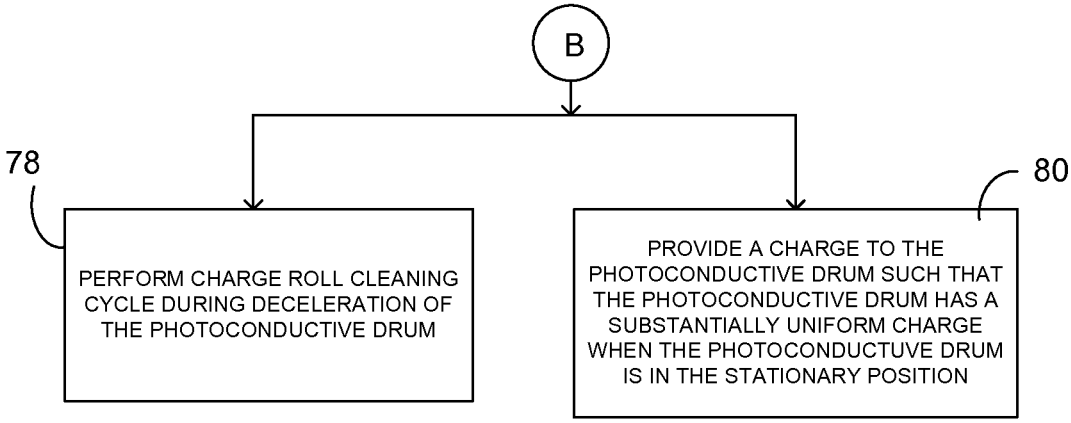
FIG. 6B illustrates the operation performed within the image forming apparatus during the deceleration of the photoconductive drums of FIG. 3 according to an exemplary embodiment of the present invention.

FIG. 6B illustrates the process performed during the deceleration of each photoconductive drum 44*y*, 44*c*, 44*m*, and

44*k*. As shown in block 78 a cleaning cycle, i.e., cleaning of any dirt or impurity, from the surface of the charging roller 46 corresponding to each photoconductive drum 44*y*, 44*c*, 44*m*, and 44*k* is performed during the deceleration of the photoconductive drum 44*y*, 44*c*, 44*m*, and 44*k*. Further, the charging roller 46 provides a charge such that each photoconductive drums 44*y*, 44*c*, 44*m*, and 44*k* has a substantially uniform charge when the photoconductive drums 44*y*, 44*c*, 44*m*, and 44*k* are in the stationary position at the end of the deceleration period, as shown in block 80. Stopping the photoconductive drums 44*y*, 44*c*, 44*m*, and 44*k* with a substantially uniform charge thereon improves the uniformity of charge on the photoconductive drums 44*y*, 44*c*, 44*m*, and 44*k*, thereby reducing the number of charge cycles needed before imaging when another print job is received by the image forming apparatus 10, thereby reducing toner churn within the image forming apparatus 10.

Additionally, according to an exemplary embodiment of the present invention, when a print job is received by the image forming apparatus 10 the controller 42 schedules the working of each component of the image forming apparatus 10. Each component is started based on the time required by that component to perform its operation. For example, the fuser assembly 24 may require the most time compared to other components, as the fuser assembly 24 is started from a standby condition. The controller 42 therefore provides instructions to start the fuser assembly 24 before starting the other components of the image forming apparatus 10. Similarly, as discussed above the rotation of the intermediate transfer member 18 is started before starting the rotation of the photoconductive drums 44*y*, 44*c*, 44*m*, and 44*k*. This ensures that the image is printed on the media with a reduced amount of toner churn and image forming apparatus wear.

One of the operations performed within the image forming apparatus 10 is a laser servo process for laser power setting and horizontal synchronizing that is utilized for exposing the photoconductive drums 44*y*, 44*c*, 44*m*, and 44*k*. In prior systems, the laser servo process was performed when the photoconductive drums 44*y*, 44*c*, 44*m*, and 44*k* were rotating at the print speed. As the photoconductive drums 44*y*, 44*c*, 44*m*, and 44*k* were rotating during the laser servo process it resulted in toner churn within the image forming apparatus 10 due to the additional rotations of the photoconductive drums 44*y*, 44*c*, 44*m*, and 44*k*.

Figure 7:
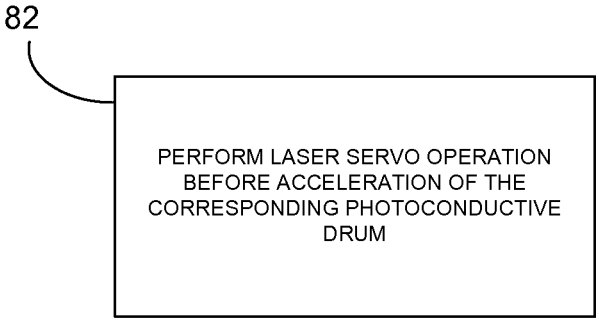
FIG. 7 is a block diagram illustrating the laser servo process of the image forming apparatus of FIG. 1 according to an exemplary embodiment of the present invention.

FIG. 7 is a block diagram illustrating the laser servo process performed within the image forming apparatus 10 of FIG. 1 according to an exemplary embodiment of the present invention. As shown in block 82, the laser servo process in the present invention is performed for each photoconductive drum 44 before the start of rotation and/or before the start of acceleration of the photoconductive drum 44. As the laser servo process for all the photoconductive drums 44 is performed before the photoconductive drums 44 accelerate, the photoconductive drums 44 do not perform additional rotations for the image transfer process as in prior systems. This results in the image forming apparatus 10 performing the image forming process with reduced drum rotation, thus reducing toner churn.

Another operation performed within the image forming apparatus 10 is a transfer servo for the image transfer process. In order to successfully transfer the portion of image from the photoconductive drums 44 to the intermediate transfer member 18, a voltage is applied to each photoconductive drum 44 and its corresponding transfer roller 50. This voltage is dependent on a number of environmental conditions. For example, the transfer servo voltage may change if the temperature or humidity changes beyond a certain amount. Transfer servo includes the process of determining the voltage to be used in order to successfully transfer the toner image from the photoconductive drums 44 to the intermediate transfer member 18. In prior systems, the transfer servo process was performed for each print job received by the image forming apparatus 10. Transfer servo is done after the photoconductive drums are running at process speed and before imaging begins which results in toner churn.

Figure 8:
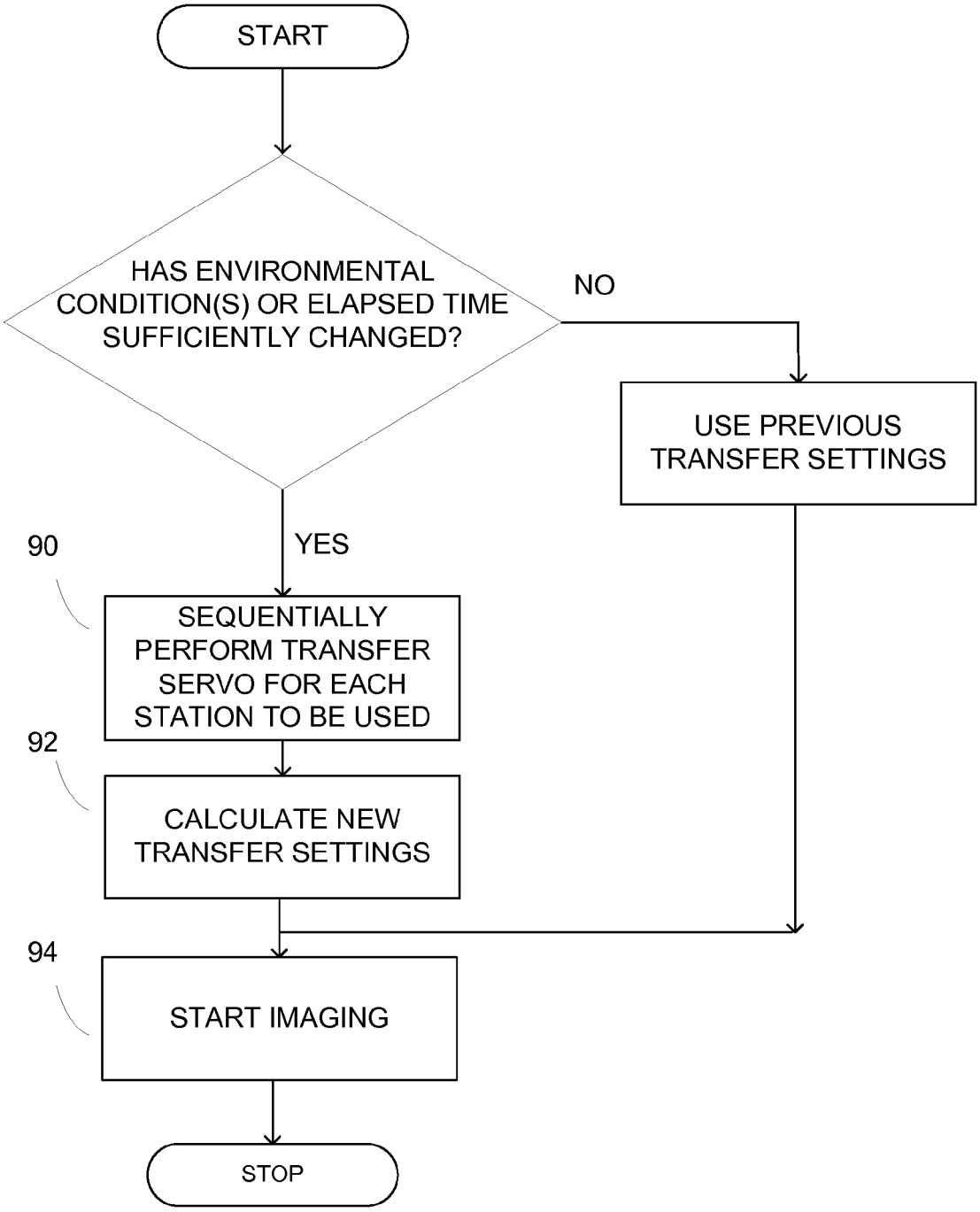
FIG. 8 is a block diagram illustrating the transfer servo process of the image forming apparatus of FIG. 1 according to an exemplary embodiment of the present invention.

FIG. 8 illustrates the transfer servo process within the image forming apparatus 10 of FIG. 1 according to an exemplary embodiment of the present invention. As indicated, the transfer servo process is performed only when the elapsed time since the last print operation or at least one environmental condition of the image forming apparatus 10, such as humidity, has changed beyond a predetermined range. For example, if a print job is received immediately after printing another print job, the transfer servo process may be eliminated for that print job by using the conditions set for the prior print job. This ensures that the image transfer process is performed using reduced rotations of the photoconductive drums 44*y*, 44*c*, 44*m*, and 44*k*, thus avoiding any toner churn issues seen in prior systems.

Further, in prior systems the transfer servo for all the photoconductive drums 44*y*, 44*c*, 44*m*, and 44*k* was performed simultaneously. This was done to eliminate cross talk between adjacent photoconductive drums 44*y*, 44*c*, 44*m*, and 44*k*. However, this process requires the photoconductive drums 44*y*, 44*c*, 44*m*, and 44*k* to be rotating simultaneously at the print speed, which resulted in excess toner churn.

As shown in FIG. 8, the transfer servo process for each photoconductive drum 44*y*, 44*c*, 44*m*, and 44*k* and corresponding transfer roller 50 is performed sequentially at 90. Transfer servo operations require less travel distance than the distance between image forming stations 20, so sequential transfer servo operations do not have cross talk since no more than one is being performed at a time. Following completion of the transfer servo operation, new transfer voltage settings are determined at 92 for use in transferring a toner image at 94.

In the event the environmental condition has not changed beyond its corresponding predetermined range and the elapsed time since the last print operation has not exceeded a predetermined amount of time, a transfer servo operation is not performed and previously determined transfer voltage settings are used in transferring the toner image at 94.

Another improvement in the transfer servo process according to an exemplary embodiment of the present invention is that it is performed after charging the photoconductive drum 44 to the print voltage. In prior systems, the transfer servo was done at an arbitrary voltage setting and the photoconductive drums 44*y*, 44*c*, 44*m*, and 44*k* were subsequently rotated and charged to the print voltage. This required the photoconductive drums 44*y*, 44*c*, 44*m*, and 44*k* to perform additional rotations during the charging process, resulting in additional toner churn. Performing the transfer servo with the photoconductive drums 44*y*, 44*c*, 44*m*, and 44*k* charged at the print voltage eliminated these additional rotations of the photoconductive drums 44*y*, 44*c*, 44*m*, and 44*k*, thus reducing toner churn.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method of reducing wear in an image forming apparatus, the image forming apparatus comprising a plurality of photoconductive drums in contact with and disposed along an intermediate transfer member, the plurality of photoconductive drums transferring an image to the intermediate transfer member during a print operation, the method comprising:

individually accelerating each photoconductive drum to a print speed at which image transfer by the photoconductive drum is performed; and individually decelerating each photoconductive drum from the print speed towards a stationary position during the print operation;

wherein rotation of at least one photoconductive drum during the print operation begins at a different time relative to a time another of the photoconductive drums begins rotating during the print operation.

2. The method of claim 1, wherein each photoconductive drum other than a most upstream photoconductive drum begins accelerating after an immediately upstream photoconductive drum begins accelerating and before exposing the immediately upstream photoconductive drum with a portion of the image, and wherein each photoconductive drum other than a most downstream photoconductive drum begins decelerating after image exposure by an immediately downstream photoconductive drum is complete.

3. The method according to claim 2, wherein each photoconductive drum other than the most downstream photoconductive drum begins decelerating prior to a time the immediately downstream photoconductive drum begins decelerating.

4. The method according to claim 1, wherein each photoconductive drum rotates during acceleration approximately a minimum distance to perform a run-in operation on the photoconductive drum.

5. The method according to claim 1, wherein each photoconductive drum rotates during acceleration about a distance needed to substantially uniformly charge the photoconductive drum for the print operation.

6. The method of claim 1, wherein each photoconductive drum rotates during deceleration a greater of a distance between adjacent photoconductive drums, a distance needed to substantially uniformly charge the photoconductive drum, and a distance to perform a charge roll cleaning on a corresponding charge roll.

7. The method of claim 1, wherein each photoconductive drum rotates during deceleration approximately a distance needed to perform a run-out operation on the photoconductive drum.

8. The method according to claim 1, further comprising performing a transfer servo operation on each photoconductive drum when the photoconductive drum is charged to a voltage that will be used for printing.

9. The method according to claim 1, further comprising performing a transfer servo operation on each photoconductive drum sequentially without an overlap in time.

10. The method according to claim 1, further comprising applying a bias voltage to each photoconductive drum during acceleration thereof, including changing a DC component of the bias voltage based upon a rotational speed of the photoconductive drum.

11. The method of claim 1, further comprising performing a transfer servo operation only when the elapsed time since the last print operation or at least one environmental condition of the image forming apparatus has changed beyond a predetermined amount.

12. The method of claim 1, wherein each photoconductive drum other than a most upstream photoconductive drum begins accelerating after an immediately upstream photoconductive drum begins accelerating.

13. The method according to claim 1, further comprising performing a laser servo operation on each photoconductive drum before the photoconductive drum begins accelerating.

14. An image forming apparatus comprising:

an intermediate transfer member;

a plurality of photoconductive drums in contact with and disposed along the intermediate transfer member, the plurality of photoconductive drums transferring an image to the intermediate transfer member during a print operation;

a plurality of charging rollers positioned in contact with the plurality of photoconductive drums; and a controller providing instructions to the image forming apparatus for individually accelerating each photoconductive drum to a print speed at which image transfer is performed, and individually decelerating each photoconductive drum from the print speed towards a stationary position during the print operation;

wherein rotation of at least one photoconductive drum during the print operation has a start time that is different relative to a corresponding start time of rotation of another of the photoconductive drums during the print operation.

15. The apparatus of claim 14, wherein the controller provides the instructions for:

accelerating each photoconductive drum other than a most upstream photoconductive drum after an immediately upstream photoconductive drum begins accelerating and prior to exposing the immediately upstream photoconductive drum with a portion of the image; and decelerating each photoconductive drum other than a most downstream photoconductive drum after image exposure by an immediately downstream photoconductive drum is complete.

16. The image forming apparatus of claim 15, wherein each photoconductive drum other than the most downstream photoconductive drum begins decelerating prior to a time the immediately downstream photoconductive drum begins decelerating.

17. The image forming apparatus of claim 14, wherein each photoconductive drum rotates during acceleration approximately a distance needed to perform a run-in operation.

18. The image forming apparatus of claim 14, wherein each photoconductive drum rotates during acceleration approximately a distance needed to substantially uniformly charge the photoconductive drum for the print operation.

19. The image forming apparatus of claim 14, wherein each photoconductive drum rotates during deceleration a greater of a distance between adjacent photoconductive drums, a distance needed to substantially uniformly charge or discharge the photoconductive drum, and a distance to perform a charge roll cleaning on the corresponding charge roll.

20. The image forming apparatus of claim 14, wherein each photoconductive drum rotates during deceleration approximately a minimum distance to perform a run-out operation on the photoconductive drum.

21. The image forming apparatus of claim 14, wherein the controller initiates a transfer servo operation on each photoconductive drum when the photoconductive drum is at a print voltage.

22. The image forming apparatus of claim 14, wherein the controller provides instructions to the image forming apparatus to start rotating the intermediate transfer member before rotating the photoconductive drums.

23. The image forming apparatus of claim 14, wherein the controller causes a transfer servo operation to be performed only when the elapsed time since the last print operation or at least one environmental condition of the image forming apparatus has changed beyond a predetermined amount.

24. The image forming apparatus of claim 14, wherein the controller provides instructions for accelerating each photoconductive drum other than a most upstream photoconductive drum after an immediately upstream photoconductive drum begins accelerating.

25. The image forming apparatus of claim 14, wherein the controller initiates a laser servo operation on each photoconductive drum before the photoconductive drum begins accelerating.

26. An image forming apparatus, comprising:

an intermediate transfer member;

a plurality of photoconductive drums in contact with the intermediate transfer member, the plurality of photoconductive drums arranged along the intermediate transfer member, the plurality of photoconductive drums transferring an image to the intermediate transfer member during a print operation; and a controller providing instructions to the image forming apparatus for separately rotating each photoconductive drum during a print operation, the rotation of at least one photoconductive drum beginning at a different time relative to a time the other photoconductive drums begin rotating and ending at a different time relative to a time the other photoconductive drums end rotating.

27. The apparatus of claim 26, wherein the rotation of each photoconductive drum begins at a different time relative to a time the other photoconductive drums begin rotating and ends at a different time relative to a time the other photoconductive drums end rotating.

28. The apparatus of claim 26, wherein each photoconductive drum downstream of a most upstream photoconductive drum begins rotating after an immediately upstream photoconductive drum begins rotating and before the immediately upstream photoconductive drum starts transferring a portion of the image to the intermediate transfer member.

29. The apparatus of claim 26, wherein each photoconductive drum upstream of a most downstream photoconductive drum begins decelerating towards a stationary position after image transfer by an immediately downstream photoconductive drum is substantially complete and before the immediately downstream photoconductive drum begins decelerating.

30. The apparatus of claim 26, wherein the photoconductive drums are rotated using an acceleration ramp that is longer in time than a time for the intermediate transfer member to travel between adjacent photoconductive drums.

31. A method of reducing wear in an image forming apparatus, the image forming apparatus comprising a plurality of photoconductive drums in contact with and disposed along an intermediate transfer member, the plurality of photoconductive drums transferring an image to the intermediate transfer member during a print operation, the method comprising:

individually accelerating each photoconductive drum to a print speed at which image transfer by the photoconductive drum is performed; and individually decelerating each photoconductive drum from the print speed towards a stationary position during the print operation;

wherein each photoconductive drum rotates during deceleration a greater of a distance between adjacent photoconductive drums, a distance needed to substantially uniformly charge the photoconductive drum, and a distance to perform a charge roll cleaning on a corresponding charge roll.

32. A method of reducing wear in an image forming apparatus, the image forming apparatus comprising a plurality of photoconductive drums in contact with and disposed along an intermediate transfer member, the plurality of photoconductive drums transferring an image to the intermediate transfer member during a print operation, the method comprising:

individually accelerating each photoconductive drum to a print speed at which image transfer by the photoconductive drum is performed;

individually decelerating each photoconductive drum from the print speed towards a stationary position during the print operation; and applying a bias voltage to each photoconductive drum during acceleration thereof, including changing a DC component of the bias voltage based upon a rotational speed of the photoconductive drum.

33. An image forming apparatus comprising:

an intermediate transfer member;

a plurality of photoconductive drums in contact with and disposed along the intermediate transfer member, the plurality of photoconductive drums transferring an image to the intermediate transfer member during a print operation;

a plurality of charging rollers positioned in contact with the plurality of photoconductive drums; and a controller providing instructions to the image forming apparatus for individually accelerating each photoconductive drum to a print speed at which image transfer is performed, and individually decelerating each photoconductive drum from the print speed towards a stationary position during the print operation;

wherein each photoconductive drum rotates during deceleration a greater of a distance between adjacent photoconductive drums, a distance needed to substantially uniformly charge or discharge the photoconductive drum, and a distance to perform a charge roll cleaning on the corresponding charge roll.

* * * * *